US009159213B1

(12) United States Patent
Chun et al.

(10) Patent No.: US 9,159,213 B1
(45) Date of Patent: Oct. 13, 2015

(54) MOTION DETECTION METHOD AND DEVICE

(71) Applicant: NATIONAL CHUNG SHAN INSTITUTE OF SCIENCE AND TECHNOLOGY

(72) Inventors: Chin-Wei Chun, New Taipei (TW); Teh-Long Lai, New Taipei (TW)

(73) Assignee: NATIONAL CHUNG SHAN INSTITUTE OF SCIENCE AND TECHNOLOGY (TW)

( * ) Notice: Subject to any disclaimer, the term of this patent is extended or adjusted under 35 U.S.C. 154(b) by 0 days.

(21) Appl. No.: 14/333,596

(22) Filed: Jul. 17, 2014

(51) Int. Cl.
*G08B 21/04* (2006.01)

(52) U.S. Cl.
CPC ..... *G08B 21/0446* (2013.01)

(58) Field of Classification Search
CPC .. A61B 5/1116; A61B 5/1117; A61B 5/0002; A61B 2562/0219; G08B 21/0446; G08B 21/0453; G08B 23/00
USPC ..... 340/669, 689, 573.1, 573.3, 573.7, 340/539.1, 539.11, 539.12, 286.07; 702/141, 150; 600/300, 301
See application file for complete search history.

(56) References Cited

U.S. PATENT DOCUMENTS

| | | | | |
|---|---|---|---|---|
| 6,201,476 | B1 * | 3/2001 | Depeursinge et al. | 340/573.1 |
| 6,433,690 | B2 * | 8/2002 | Petelenz et al. | 340/573.1 |
| 7,095,331 | B2 * | 8/2006 | Lehrman et al. | 340/669 |
| 8,909,497 | B1 * | 12/2014 | Shkolnikov | 702/141 |
| 2005/0021312 | A1 * | 1/2005 | Tanaka et al. | 702/189 |
| 2006/0214806 | A1 * | 9/2006 | Clifford et al. | 340/573.1 |

* cited by examiner

*Primary Examiner* — Hung T Nguyen
(74) *Attorney, Agent, or Firm* — Schmeiser, Olsen & Watts, LLP

(57) ABSTRACT

A motion detection method and device are introduced. The motion detection method is adapted to detect accelerations of an intended target along the x-axis, y-axis, and y-axis, respectively, and determine whether the intended target is in a fallen state or is undergoing a falling motion according to a signal strength algorithm and an average force field algorithm. The motion detection device includes an acceleration sensing unit for detecting acceleration along the x-axis, y-axis, and y-axis; a computing unit for determining a falling motion according to the acceleration along the x-axis, y-axis, and y-axis; and a transmitting unit for sending a message pertaining to the falling motion.

6 Claims, 2 Drawing Sheets

MOTION DETECTION METHOD AND DEVICE

FIELD OF THE TECHNOLOGY

The present invention relates to motion detection technology, and more particularly, to a motion detection method and device for detecting a falling human body or object.

BACKGROUND

Conventional fallen and falling detection systems come in three categories, namely stationary, portable, and mixed. A conventional stationary fallen and falling detection system comprises a sensing device disposed, in a fixed manner or in an embedded manner, in an environment where detection is to take place. The conventional stationary fallen and falling detection system has the following advantages: it has a simple structure, and it does not require a user to wear a sensing device on the user's body. The conventional stationary fallen and falling detection system has the following disadvantages: it infringes upon individuals' privacy, its detection fails to cover dead spaces, and it incurs high infrastructure costs in effectuating installations at multiple locations, because users are never stationary. The conventional portable fallen and falling detection system has to be worn by a user or fastened to an object and thus its range of detection is restricted to the user. Hence, the conventional portable fallen and falling detection system is advantageously characterized by its being compact, portable, and cheap, but is disadvantageously characterized in that the user may forget to wear it or is unable to wear it at a specific place, such as a toilet or a bathroom. The conventional mixed fallen and falling detection system, which is basically a combination of the stationary and portable fallen and falling detection systems, is effective in detecting a fall but shares all the aforesaid disadvantages of the conventional stationary fallen and falling detection system and the conventional portable fallen and falling detection system.

The conventional portable fallen and falling detection system comprises an accelerometer, a gyroscope, and a horizon sensor for use in dynamic sensing. It is most notably effective in calculating a signal vector magnitude (SVM) in a way proposed by Mathie, with the equation $$SVM = \sqrt{ax^2 + ay^2 + az^2},$$

where ax, ay, az denotes the acceleration along the x-axis, y-axis, and z-axis, respectively. As predicated by the equation, the chance that a fall has happened is high whenever SVM>2.8 g. The Mathie estimation is simple, accurate, and insusceptible to direction-specific errors. However, the Mathie estimation is not effective in discerning taking a seat quickly, assuming a lying posture quickly, running, and leaping.

As regards detection by gyroscope, Nyan Tay puts forth a two-axis gyroscope approach which involves affixing gyroscopes to the chest, the front of the abdomen, and the right forearm, respectively, so as to detect falling backward, falling sideward, and general daily motions, such as standing up, walking, and bending forward to pick up an object, lying down, and a sit-up. In doing so, Nyan Tay identifies the angular velocity thresholds of the chest, the front of the abdomen, and the right forearm, with a sensitivity of 100% and a specificity of 84%. Furthermore, the sensors used in the Nyan Tay technique predict a fall 200 milliseconds before the falls happens. In 2008, Nyan Tay assessed the consistency in angular velocity between the trunk and the thigh with a view to determining whether a fall had occurred; in doing so, Nyan Tay not only discovered that both the sensitivity and specificity are 100% but also reduced the time taken to predict a fall to 700 milliseconds.

Although research is conducted on conventional accelerometer and gyroscope detection systems fully and fruitfully, it has hitherto failed to address those falls which are difficult to predict accurately, including taking a seat quickly, assuming a lying posture quickly, and falling into a coma at a seat.

The surge of smartphone and dynamic wearable sensors began in 2005. Tong Zhang puts forth connecting a cell phone to the Interne, using grouping algorithm in two stages. The first stage involves using 1-Class SVM (Support Vector Machine), and the second stage involves using KFD technique (Kernel Fisher Discriminant) and K-NN technique (Nearest Neighbor) in detecting a fall, resulting in a sensitivity of 93.3%. Afterward, Dai Jiangpeng proposes the equation $$|A_T| = \sqrt{|Ax|^2 + |Ay|^2 + |Az|^2},$$

where Ax, Ay, Az denote the acceleration along the x-axis, y-axis, and z-axis, respectively, and proposes $|A_V|=|A_x \sin \theta_z + A_y \sin \theta_y - A_y \cos \theta_y \cos \theta_z|$, where θx, θy, θz denote the angle of rotation about x-axis, y-axis, and z-axis, respectively, so as to determine their thresholds, respectively, but such an approach is inapplicable to the elderly who seldom carry a cell phone, not to mention that the elderly are likely to fall while using a cell phone or lose their grip on a cell phone while falling.

A new feasible trend lies in the use of at least three sensors. In Taiwan, Wang Zhizhong from the National Chiao Tung University uses an optical motion image capturing system in measuring inertial acceleration, wherein six cameras are disposed in a 2×3 rectangular array, a plurality of reflecting labels is adhered to different points along the cervical vertebrae to therefore acquire the total acceleration of 0.85 g for use a fall threshold, and an electromyography (EMG) system operates in a manner that electromyography patches are affixed to eight points of the human body, namely deltoid muscle of the upper limbs, trapezius muscle of the upper limbs, tibialis anterior muscle of the lower limbs, and gastrocnemius muscle of the lower limbs, for measuring the average maximum peak values and standard deviation of the muscular strength of the human body in daily life, wherein the fall threshold is set to the sum of the average peak value and a twofold deviation. If three of the aforesaid muscles reach the aforesaid threshold in 200 milliseconds, a fall will be predicted at a sensitivity of 95.92% and a specificity of 95.42%. A research team at the National Cheng Kung University in Taiwan integrates a three-axis accelerometer and a three-axis gyroscope to retrieve information pertaining to six axes, affixes sensors to the waist and the two knees of a subject, wherein the origin is set to a point of the waist on which a light beam is projected, so as to measure an angle θ and a distance d of a leg projection point and a waist projection point relative to the origin, and thus identify a motion path (Dwf, Awf), wherein Dwf denotes the distance between the leg projection point and the waist projection point, and Awf denotes the angle of the waist projection point relative to the leg projection point, so as to take the samples of data pertaining to the motion path within three seconds. Then, the sampled data are processed with a subtractive clustering method of a neural algorithm, wherein the upper and lower limit multiples of the potential values are set to 0.5~0.15, so as to determine whether the same motion and equilibrium related information persists, using acceleration SVM and acceleration variation rate $$A_V = \left| \frac{d\left(\sqrt{A_{x(t)}^2 + A_{y(t)}^2 + A_{z(t)}^2}\right)}{dt} \right|,$$

wherein, if Av is overly large and the subject fails to keep the balance of his or her body, it can be determined that the subject is going to fall, at a sensitivity of 97%. The benefits of multiple dynamic sensors include: accurate prediction of a fall, acquisition of plenty information pertaining to posture and motion, and detection of the other abnormal behavior. However, the use of an increasing number of sensors is accompanied by an increase in costs and an increase in the inconvenience brought to users who wear the sensors.

In view of this, sensor category and the location to wear the sensors are of vital importance, as these are two factors in the required data to be detected, the way of conducting an analysis, the performance, and the result. Users always favor sensors which can be worn on their bodies conveniently and comfortably, and Users always want to wear as few sensors as possible. Manufacturers are interested in cutting their manufacturing costs by reducing the categories and quantity of sensors.

SUMMARY

In view of the aforesaid drawbacks of the prior art, it is an objective of the present invention to provide a motion detection method and device for detecting the acceleration of an intended target along the x-axis, y-axis, and y-axis and determining whether the intended target is in a fallen state or is undergoing a falling motion according to a signal strength algorithm and an average force field algorithm.

The present invention provides a motion detection method, comprising the steps of: detecting accelerations ax, ay, az of an object under test along x-axis, y-axis, and z-axis, respectively, as soon as the object under test undergoes a motion at a first point in time; calculating absolute values |ax|, |ay|, |az| of the accelerations ax, ay, az, respectively, and defining the calculated absolute values |ax|, |ay|, |az| as a1, a2, a3, respectively, in a decreasing order; substituting a1, a2, a3 into an algorithm of a first signal strength and a second signal strength to calculate the first signal strength and the second signal strength; and determining that the object under test has undergone a fall motion when none of the first signal strength and the second signal strength is less than 2.5 g, wherein g denotes gravitational acceleration.

In an embodiment, the algorithm of the first signal strength is: $a1*\sqrt{3}$.

In an embodiment, the algorithm of the second signal strength is: $a1+(\sqrt{3}-1)*a2$.

In an embodiment, the motion detection method further comprises the steps of: measuring an average acceleration along z-axis within one second starting 0.5 second before the first point in time and ending 0.5 second after the first point in time and then set it to x; measuring the average acceleration along the z-axis within one second starting 0.5 second after the first point in time and ending 1.5 seconds after the first point in time and then set it to y; and determining that the object under test is undergoing a falling motion if $|x-y|>0.6$.

The present invention provides a motion detection device, comprising: an acceleration sensing unit, a computing unit, and a transmitting unit. The acceleration sensing unit detects the acceleration of the motion detection device along the x-axis, y-axis, and y-axis. The computing unit is connected to the acceleration sensing unit and adapted to determine whether the motion detection device undergoes a fall motion according to the acceleration along the x-axis, y-axis, and y-axis. The transmitting unit is connected to the computing unit and adapted to send a message pertaining to the fall motion which happens to the motion detection device.

The present invention provides the motion detection device. The computing unit performs the following steps: detecting accelerations ax, ay, az of an object under test along x-axis, y-axis, and z-axis, respectively, as soon as the object under test undergoes a motion at a first point in time; calculating absolute values |ax|, |ay|, |az| of the accelerations ax, ay, az, respectively, and defining the calculated absolute values |ax|, |ay|, |az| as a1, a2, a3, respectively, in a decreasing order; substituting a1, a2, a3 into an algorithm of a first signal strength and a second signal strength to calculate the first signal strength and the second signal strength; and determining that the object under test has undergone a fall motion when none of the first signal strength and the second signal strength is less than 2.5 g, wherein g denotes gravitational acceleration. The algorithm of the first signal strength is: $a1*\sqrt{3}$. The algorithm of the second signal strength is: $a1+(\sqrt{3}-1)*a2$.

The present invention provides the motion detection device. The computing unit performs the following steps: measuring an average acceleration along z-axis within one second starting 0.5 second before the first point in time and ending 0.5 second after the first point in time and then set it to x; measuring the average acceleration along the z-axis within one second starting 0.5 second after the first point in time and ending 1.5 seconds after the first point in time and then set it to y; and determining that the object under test is undergoing a falling motion if $$|x-y| > 0.6.$$

The present invention provides the motion detection device wherein the transmitting unit is a Bluetooth unit, and, when it detects a fallen state or a falling motion, sends related data by a cell phone to let the user know the fallen state or the falling motion, using APP.

The motion detection method and device of the present invention are for use in medical treatment and home care services to prevent the human body from falling, and is advantageously characterized by the use of less components and low costs. The present invention is also applicable to the prevention of the fall of a precious object, machine, and tool, and long-term monitoring of landslide in rural areas, thus saving manpower, cutting costs, and safeguarding people.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
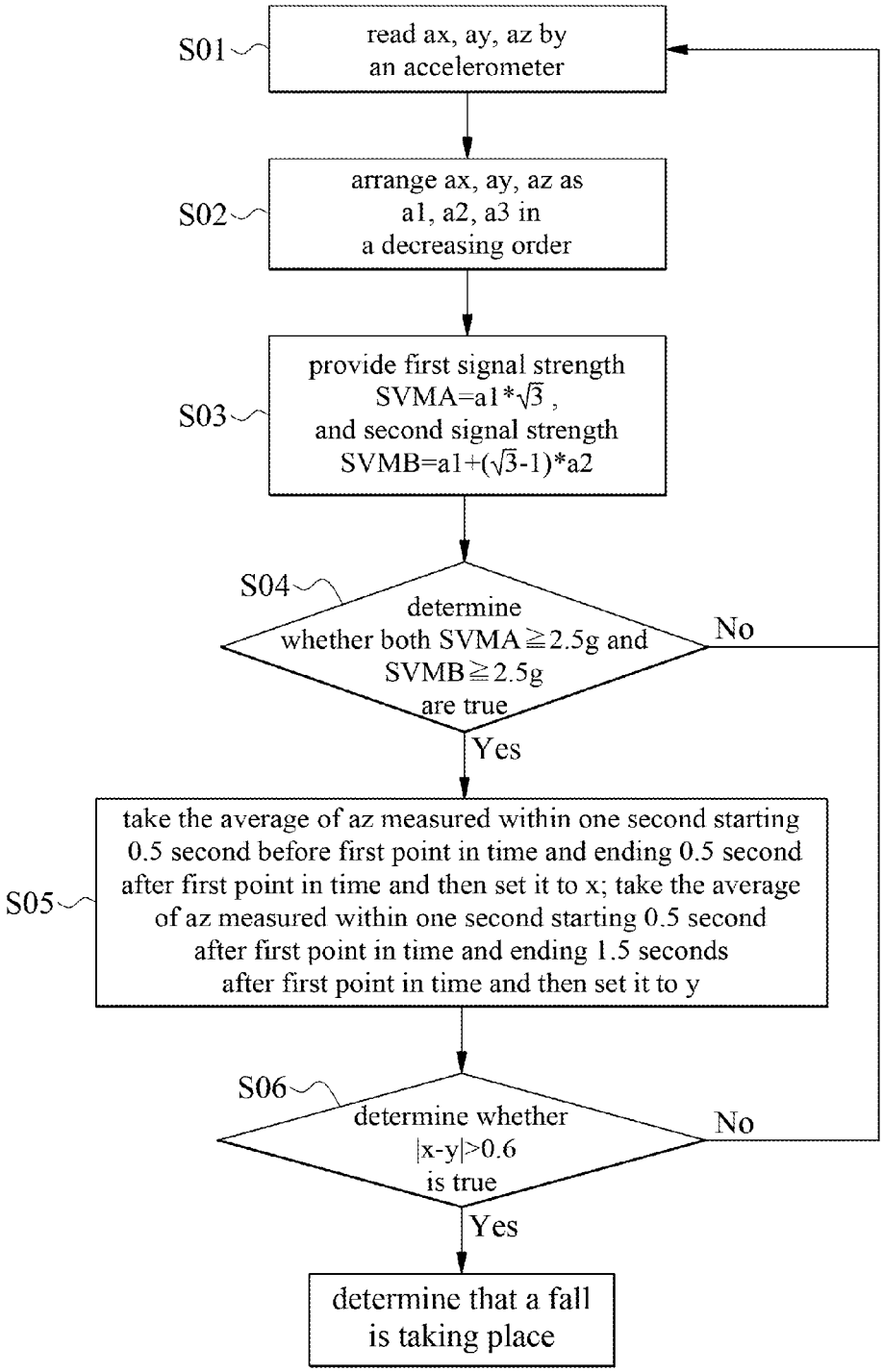
FIG. 1 is a flow chart of a motion detection method of the present invention.

To render the features and advantages of the present invention more obvious and comprehensible, the present invention is hereunder illustrated with specific embodiments.

The process flow of a motion detection method of the present invention is described as follows: when an object/subject under test is likely to fall or likely to undergo a falling motion, the instantaneous accelerations of the object/subject under test along the x-axis, y-axis, and y-axis are calculated with a semi-signal vector magnitude (semi-SVM) algorithm by a motion detection device, respectively, and then the average force field of the object/subject under test along the z-axis is calculated with the semi-SVM algorithm by the motion detection device, with a view to ruling out non-falling motions. In the end, the motion detection device sends a message indicative of a fall.

Take the human body as an example, the semi-SVM algorithm judges the instantaneous acceleration of the falling human body and determines that the human body has fallen whenever SVM≥2.8 g. To enhance its specificity, the motion detection method and device uses mathematical approximation to identify the occurrence of a fallen state or a falling motion which happens whenever the instantaneous acceleration along the z-axis is larger than the instantaneous accelerations along the x-axis and y-axis. So, it is advantageous for the motion detection method and device of the present invention to ignore the instantaneous accelerations along the x-axis and y-axis and thus minimize their effects on the final result of SVM≥2.8 g, thereby enhancing the accuracy in determining whether the human body has fallen or is undergoing a falling motion. According to the present invention, signal strength algorithm works as follows: detect accelerations ax, ay, az of the object/subject under test along the x-axis, y-axis and z-axis; calculate the absolute values |ax|, |ay|, |az| of accelerations ax, ay, az, respectively, and define the calculated absolute values |ax|, |ay|, |az| as a1, a2, a3, respectively, in a decreasing order; and determine a fallen state or a falling motion when both SVMA≥2.5 g and SVMB≥2.5 g are true, where the first signal strength $SVMA=a1*\sqrt{3}$, and the second signal strength $SVMB=a1+(\sqrt{3}-1)*a2$.

The underlying principle of average force field is described as follows: the force field in which an object moves at a constant velocity is known as a standard state force field; assuming that, in addition to the standard state force field, resultant force field oscillation always ends up with a feedback such that similar values of the standard state force field can be obtained by taking the average of the force field during a specific period of time. The present invention is characterized in that: in daily life, z-axis acceleration seldom occurs, but x-axis acceleration and y-axis acceleration often occurs (for example, as a result of a bend or a brake while riding a vehicle); hence, a result obtained by averaging the force field along the z-axis will render accurate by ignoring x-axis acceleration and y-axis acceleration. The average force field algorithm for use in the present invention is as follows: set the point in time when a falling motion is detected to A, set the average acceleration along the z-axis within the one second of A−0.5 s~A+0.5 s to x, set the average acceleration along the z-axis within the one second of A+0.5 s~A+1.5 s to y, and determine that a fallen state or a falling motion has occurred if |x-y|>0.6.

FIG. 1 is a flow chart of the motion detection method of the present invention. As shown in the diagram, step S01: in the situation where an object under test undergoes a motion at the first point in time, measure accelerations ax, ay, az of the object under test along the x-axis, y-axis and z-axis, respectively; step S02: calculate the absolute values |ax|, |ay|, |az| of the accelerations ax, ay, az, respectively, and set the calculated absolute values to a1, a2, a3, respectively; step S03: substitute a1, a2, a3 into an appropriate algorithm so as to calculate the first signal strength and the second signal strength, and calculate the first signal strength SVMA and the second signal strength SVMB; step S04: determine whether both the first signal strength and the second signal strength are not less than 2.5 g, and rule out the falling motion when the determination is negative; step S05: measure the average acceleration along the z-axis within the one second starting 0.5 second before the first point in time and ending 0.5 second after the first point in time and then set it to x, and measure the average acceleration along the z-axis within the one second starting 0.5 second after the first point in time and ending 1.5 seconds after the first point in time and then set it to y; step S06: calculate the average force field, and determine that the object under test is undergoing a falling motion if |x-y|>0.6, wherein g denotes gravitational acceleration.

Figure 2:
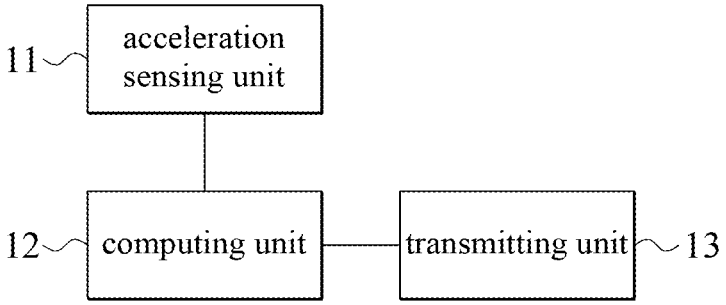
FIG. 2 is a function block diagram of a motion detection device of the present invention.

FIG. 2 is a function block diagram of the motion detection device of the present invention. As shown in the diagram, the motion detection device comprises an acceleration sensing unit 11, a computing unit 12, and a transmitting unit 13. The acceleration sensing unit 11 detects acceleration along the x-axis, y-axis, and y-axis. The computing unit 12 is connected to the acceleration sensing unit and adapted to determine whether the motion detection device undergoes a fall motion according to the acceleration along the x-axis, y-axis, and y-axis. The transmitting unit 13 is connected to the computing unit and adapted to generate a message pertaining to the fall motion.

The motion detection device of the present invention can be worn on the human body, including the waist, the hand, and the shoulder, and is adapted to prevent the human body from falling. The motion detection device of the present invention can be mounted on a precious object, machine, tool, or decoration which has to be detected for a fallen state or a falling motion instantly, thereby serving as a fall alert device.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A motion detection method, comprising the steps of:

detecting accelerations ax, ay, az of an object under test along x-axis, y-axis, and z-axis, respectively, as soon as the object under test undergoes a motion at a first point in time;

calculating absolute values |ax|, |ay|, |az| of the accelerations ax, ay, az, respectively, and defining the calculated absolute values |ax|, |ay|, |az| as a1, a2, a3, respectively, in a decreasing order;

substituting a1, a2, a3 into an algorithm of a first signal strength and a second signal strength to calculate the first signal strength and the second signal strength; and determining that the object under test has undergone a fall motion when none of the first signal strength and the second signal strength is less than 2.5 g, wherein g denotes gravitational acceleration.

2. The motion detection method of claim 1, further comprising the steps of:

measuring an average acceleration along z-axis within one second starting 0.5 second before the first point in time and ending 0.5 second after the first point in time and then set it to X;

measuring the average acceleration along the z-axis within one second starting 0.5 second after the first point in time and ending 1.5 seconds after the first point in time and then set it to y; and determining that the object under test is undergoing a falling motion if $|x-y|>0.6$.

3. The motion detection method of claim 1, wherein the algorithm of the first signal strength is: $a1*\sqrt{3}$.

4. The motion detection method of claim 1, wherein the algorithm of the second signal strength is: $a1+(\sqrt{3}-1)*a2$.

5. A motion detection device, comprising:

an acceleration sensing unit for detecting an acceleration of an object under test along the x-axis, y-axis, and y-axis;

a computing unit connected to the acceleration sensing unit and adapted to determine whether the object under test is undergoing a falling motion, using the motion detection method of claim 1 or 2 and according to the acceleration along the x-axis, y-axis, and y-axis; and a transmitting unit connected to the computing unit and adapted to generate a message pertaining to the falling motion.

6. The motion detection device of claim 5, wherein the transmitting unit is a Bluetooth unit.

* * * * *